US005375281A

United States Patent [19]

Hamann

[11] Patent Number: 5,375,281

[45] Date of Patent: Dec. 27, 1994

[54] METHOD FOR TREATING AND IN PARTICULAR DYEING FABRIC WARP-THREADS

[75] Inventor: Hans-Jörg Hamann, Langenhagen, Germany

[73] Assignee: Hans-Jorg Hamann, Wedemark, Germany

[21] Appl. No.: 8,799

[22] Filed: Jan. 28, 1993

[30] Foreign Application Priority Data

Jan. 29, 1992 [DE] Germany ..... 4202316

[51] Int. Cl.[5] ..... D06B 3/04

[52] U.S. Cl. ..... 8/151; 8/151.2

[58] Field of Search ..... 68/3, 184, 181 R; 8/151, 151.2

[56] References Cited

U.S. PATENT DOCUMENTS 3,498,086 3/1970 Williams ..... 68/9
3,687,607 8/1972 Yazawa ..... 8/151.2
3,775,054 11/1973 De Vinney ..... 8/151.2
4,569,107 2/1986 Pomeroy ..... 8/151.2
4,622,040 11/1986 Nichols, Jr. ..... 8/151

FOREIGN PATENT DOCUMENTS 1098258 3/1981 Canada ..... 68/9

*Primary Examiner*—Frankie L. Stinson
*Attorney, Agent, or Firm*—Longacre & White

[57] ABSTRACT

The instant invention provides a method for treating, in particular, for dyeing fabric warps, wherein the warps in the raw (white) state pass through a so-called sizing bath which rigidifies them and makes them more wear-resistant. The warps so treated are then woven and the textile so made is dyed in a manner to drastically lower costs. The invention calls for untreated warps in the raw (white) state to pass in-line through at least one bath containing the size in a single operational step, the dyes to be deposited being present as a viscous or pasty substance in the bath in addition to the size.

22 Claims, 1 Drawing Sheet

METHOD FOR TREATING AND IN PARTICULAR DYEING FABRIC WARP-THREADS

BACKGROUND OF THE INVENTION

Field of the Invention

The invention concerns a method and equipment for treating, and in particular, for dyeing fabric warp threads, wherein the warp threads, or warps, while in the raw (white) state, are made to pass in a single operational step through a so-called sizing bath which rigidifies the warps and making them more wear-resistant wherein the dyes to be deposited are present in as a viscous material or in a pasty state in the sizing bath. The warps so treated may then be woven and/or further dyed in a post-processing stage.

Background of the Related Methods

This known procedure incurs the following drawback. Because the warps are dyed subsequent to the making of the fabric, the finishing time is comparatively long in white weaving due to special operational steps that are incurred relating to interim storage, interim drying and the like. As a result, fabrics treated in this manner are costlier.

SUMMARY OF THE INVENTION

Accordingly, it is the object of the invention to create a method and apparatus which serves to lower these operational costs.

The novelty of the instant invention lies in the fact that untreated warps in the raw (white) state are made to pass in a single operational step through at least one bath containing the sizing substance, i.e. the size, wherein the dyes to be deposited are present as a viscous material or in a pasty state in the bath in addition to the size.

This method eliminates the necessity for subsequent dyeing at a remote third station. Instead, the warps are simultaneously treated with size and dye in a single operational step while passing through a single apparatus, i.e. in an in-line operation. Thus, the entire operational step to make dyed and sized warps is carried out in much less time than in the known procedure.

It was discovered in surprising manner that satisfactory dye deposition may be achieved in spite of maintaining the in-line speed of about 23 m/min. This is also and especially the case when the dye is present not as a dye liquor, but instead, as a viscous medium or in a pasty state.

However, the advantages of the method of the present invention are also obtained when dyeing the warps before the sizing operation at another station for multicolor weaving. Similarly, all the operational stages such as interim storage, interim drying and the like are eliminated.

Equipment with which to carry out the method of the invention appropriately comprises at least one trough receiving the bath of sizes and viscous dye; the warps to be treated being made to pass through the trough by means of conveyor rollers.

However, it is equally feasible to sequentially mount, directly in cascade, one trough for the size and one trough for the dye. It should be noted, however, that the size and the dye are deposited in a single, in-line operational step.

In the preferred embodiment of the present invention, the trough(s) are be mounted in-line directly in front of a drying chamber wherein the warps treated with size and dye are subjected to drying. This design allows further treatment of the dyed warps beyond the drying chamber proper, for example, to print and coat the dyed warps, and in particular in the form of wet-in-wet treatment feasible for dyes or coatings in the form of dispersion coatings. However, the apparatus of the present invention also makes it possible to mount a further printing system in-line and directly after the drying chamber proper, so that coating the warps with dye, lacquer, dispersions or the like is possible after the drying procedure.

In the latter embodiment, the printing system may comprise a dye reservoir from which dye is fed to the surfaces of printing rollers. The printing rollers can be forced against a rest surface, with the warps inserted therebetween; the rest surface being a lower roller. In particular, this design allows shaping the lower-roller surfaces so as to achieve different pressures on the warps at different roller locations.

Advantageously, the emulsion consisting of dye and size, contained in a reservoir and transferrable into the trough(s), shall be kept in a fluid state, wherein at least one agitator system is provided for the purpose of maintaining a fluid state by acting on the substance. Corresponding considerations regarding agitators apply to the dye receptacles.

Depending on the particular requirements, the agitator systems may be adjusted in such manner that they do not agitate the entire substance, but only a portion of it. As a result, marbling veins or tracks shall be formed and transferred to the warps. In this manner, corresponding patterns will be formed on the finished textiles, and these patterns can further be controlled by brushes or the like at the post-processing stages in manners known, per se, to produce the final-dyed warps.

The particular dye may be fed from dye receptacles to the troughs via feed lines, wherein the receptacles are equipped with a return line and a pump in order to return unused dye from the troughs to the dye receptacles. Therefore, the dye can be used up almost in its entirety.

Dyeing by the wet-in-wet procedure may also be achieved by the method and apparatus of the instant invention.

In this manner, excess dyes still contained in the warps may be squeezed out laterally and reach adjacent zones; thus, further affecting the color pattern.

Brush processing can take place both in front of and behind the drying chamber. However, brush processing may take place in front of the drying chamber only when dyeing has taken place beforehand.

At least one dye receptacle may be connected to size feed lines, wherein thickened pastes of dye pigments are fed in a controlled manner from the receptacle(s) to the size.

The dye recipes can be selected in such manner that the desired quantities of dye are absorbed simultaneously or adhere in part or in whole to the warps, even though the sizes are deposited at full production speed as mentioned above. The recipes can be controlled in such manner that a choice can be made between excesses and shortages of dye. Excesses of dye illustratively may be used so that, after a special desizing procedure, the filling threads are dyed at the same time. Thus, a dye magazine with dye pigment pastes may be additionally connected to the feed lines for the sizing materials, as a result of which the dye can be fed, in addition and as required, to the sizing materials.

Moreover, it is possible to simultaneously dye the initially separately arriving warps in different colors using separately controlled size receptacles.

It is furthermore possible to make use of a closed dye circuit passing through one or several dye receptacles to change the dyes as the warps keep moving and to prevent losses from standing or accumulations.

The closed dye loops ensure almost full consumption of the supplied material, as a result of which additional wastes are averted in production.

Wet-in-wet printed dye or dye-structure effects can be achieved in the immediate operational vicinity of the drying chamber by means of synchronously operating dye or deposition systems for the warps which can be adjustably dried in a drying chamber of which the humidity is monitored. In addition, further yarn changes and effects can be achieved by the actions of concurrently operating sponging, smoothing and brush rollers.

Again, the sorted incoming warps can be processed directly upon leaving the drying chamber by means of a further synchronously operating dyeing or deposition system. Because all warps are already being sorted at that site and are exiting while hot, the entire set of warps can be printed, coated or processed with arbitrary patterns. By printing or coating these hot warps, a novel interaction has been created between the printing and coating material on one hand, and on the other, the warps.

This effect is reinforced by the alternating exit of the warps from the fabric top and bottom sides.

The invention is elucidated below in relation to illustrative embodiments shown in the drawings.

DESCRIPTION OF THE PREFERRED EMBODIMENT

In all Figures, the warps move through the equipment in the direction of arrow 1, that is, from left to right as shown.

Figure 1:
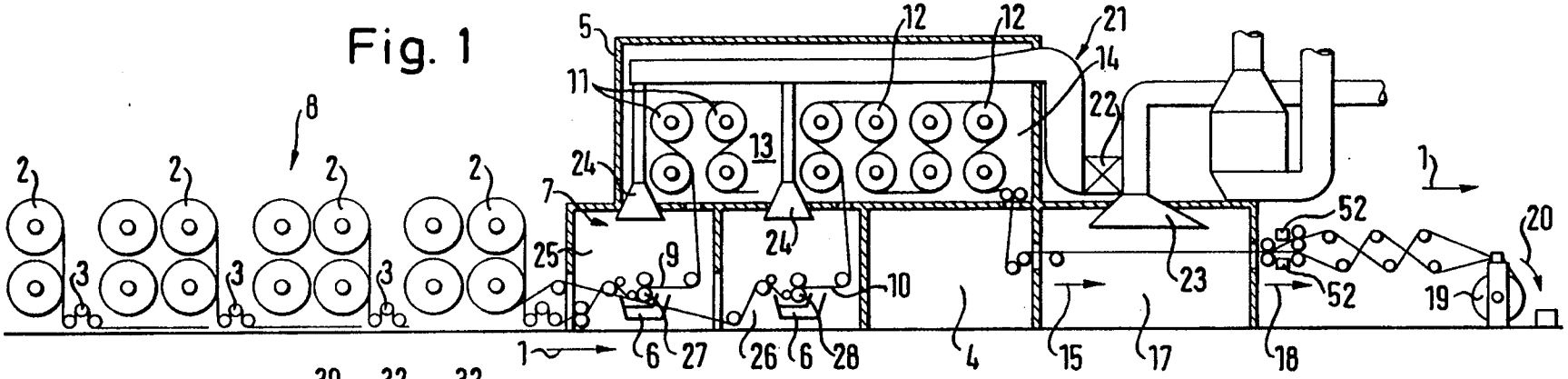
FIG. 1 is a schematic elevation of one embodiment of the overall equipment of the invention.

The initially untreated warps are wound on bobbins 2 or the like and pass through separating and sorting devices 3. Next, there is a drying chamber 4 with a housing 5 which to save energy may also includes the equipment of FIG. 2. As schematically shown in FIG. 1, two or more sequential troughs 6 may be used for coating in the above described manner. This equipment part is denoted by 7 (also see FIG. 2).

Because the warps have already been separated into upper and lower threads in the antechamber 8 containing the bobbins 2, the warps can be assigned to different troughs 6, as shown in FIG. 1. It should be noted that the troughs may be filled with different sizing agents or sizes, but are preferably filled with different dyes.

In the embodiment shown in FIG. 1, first the lower threads 10 and then the upper threads 9 are coated.

The warps so coated and dyed pass over preferably heated rollers 11 and 12 into the actual drying chamber 4 where their drying is completed. Because the drying chamber 4 and the heating-roller equipped compartments 13 and 14 are subjected to air heating (a temperature of about 140° C. being generated in the drying chamber, that is, within the housing 5), pre-drying takes place in the compartments 13 and 14 and this pre-drying is completed in chamber 4. As a result of which, the dried threads are hot when they exit the drying chamber in the direction of arrow 15.

Figure 3:
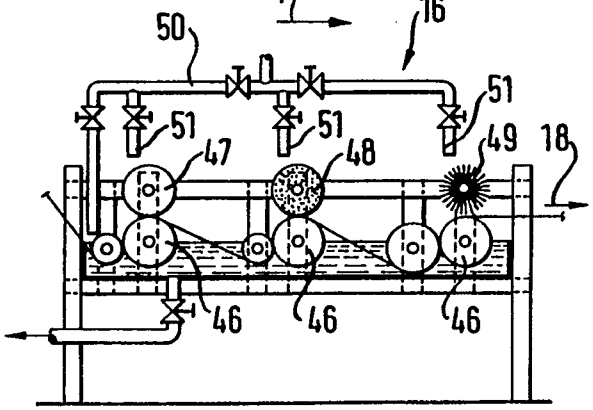
FIG. 3 is a schematic elevation enlarged relative to FIG. 1 of that part of the equipment where the warps are additionally printed or coated.

Seen in the direction of advance, the equipment part 16 of FIG. 3 follows and joins the drying chamber; the equipment part 16 being inside the compartment 17. The coated and dyed warps leave the compartment 17 in the direction of arrow 18, and, as shown, are separated into upper and lower threads. In other words, the warps are sorted so that they may be wound on warp beam 19 or the like. For that purpose, the warp beam rotates in the direction of arrow 20.

As discussed above, the drying chamber 5 is equipped with an air heating system 21 of which the heater element is denoted by 22. The piping of the heating system 21 comprises hot or warm-air discharge means 23 and 24 through which the heated air is fed to the compartment 17 and also to compartments 25 and 26. In the preferred embodiment, the compartments 25 and 26 also serve to heat the pre-heating compartments 13 and 14.

Figure 2:
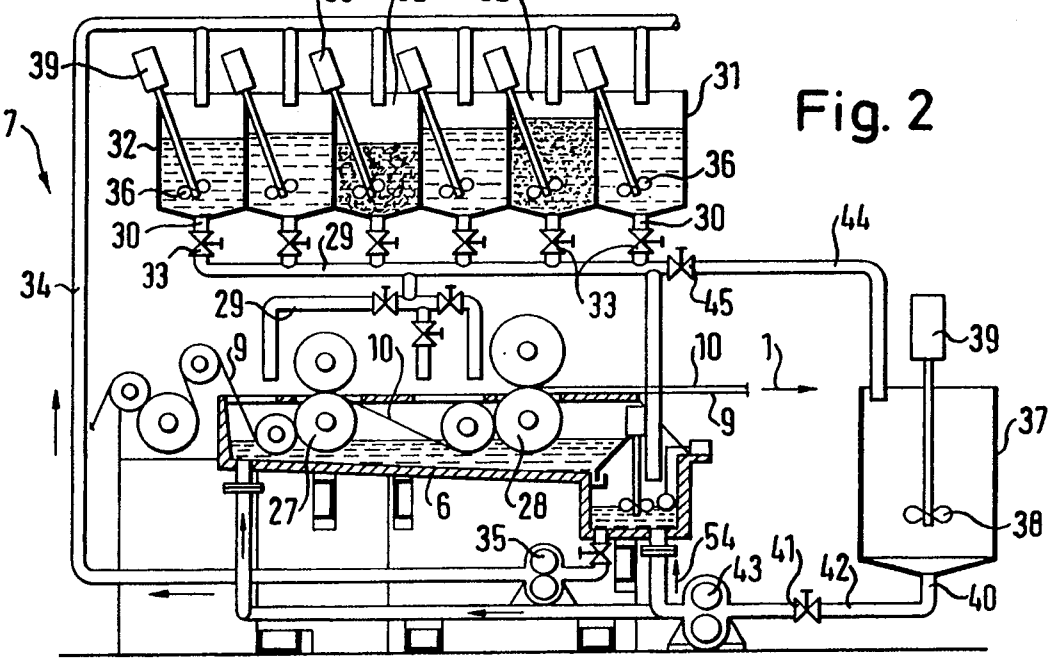
FIG. 2 is a schematic elevation on an enlarged scale relative to FIG. 1 of that part of the equipment wherein the warps are coated and dyed.

As shown by FIG. 1, the compartments 25 and 26 hold the equipment parts represented by FIG. 2, which comprise a trough 6 holding a mixture or an emulsion of the sizes and the viscous dye. The warps 9 and 10 are made to pass through the trough 6 by means of rollers 27 and 28 (also see FIG. 2). The trough 6 is connected by a pipe system 29 to the drains 30 of individual dye receptacles 31 and 32, wherein the drains 30 can be selectively closed by valves 33. Unconsumed material is returned until total consumption has taken place to the dye receptacles 32 by means a return line 34 driven by at least one pump 35. It should be noted that, as illustrated in FIG. 1 and described above, the embodiment of the instant invention may comprises more than one sequential trough 6 wherein a trough containing size and a trough containing dye are mounted directly one behind the other. The size and dye are thus deposited in-line in a single operational stage. Moreover, the piping arrangement which supplies dye and size may be designed to provide a flexible distribution system for selectively supplying varying amounts of dye and size to the warps.

As shown in FIG. 2, the trough 6 is provided with control equipment which regulates the the amount and condition of the size and dye mixture supplied to the trough 6. By way of example, the trough 6 is provided with a quantity sensor which controls the amount of mixture supplied to the trough to ensure efficient and effective treatment of the warps. Additionally, the trough 6 is provided with an agitator to maintain the mixture in a liquid state.

The individual dye receptacles 31, 32 comprise agitating means 36 which keep the viscous or pasty dyes in the dye receptacles 32 in a fluid state.

A vessel, or reservoir 37 holds the size and dye mixture and is treated with an agitator 38 which is driven by a motor 39; just as are the motors of the agitators 36 of FIG. 2.

The size reservoir 37 also comprises a drain stub 40 with a shutoff valve 41 mounted in a line 42 leading to a pump 43 feeding the size upward in the direction of the arrow 54 into the trough 6. Therefore, the reservoir 37 and pump 43 serve to regulate the amount mixture supplied to the trough(s) 6. The vessel 37 further communicates by a connecting line 44 with the drains 30 of the dye receptacles 32, wherein the connecting line 44 also contains a shutoff valve 45. Therefore, the dye contained in the dye receptacles 32 can be fed in varying quantities, in varying compositions and where called for in varying consistencies into the size reservoir 37. The piping arrangement described above is not, however, limited to those embodiments shown in FIGS. 1-3, but rather is designed to efficiently and economically distribute the dye and size in desired amounts to desired locations.

FIG. 3 shows that part of the equipment belonging in the compartment 17 of FIG. 1 and which to some extent serves to post-process the treated warps. As shown by FIG. 3, additional printing may be applied by the wet-in-wet procedure in this post-processing stage, for instance, by using synchronously cooperating dye or deposition devices 46. Moreover, additional smoothing rollers 47, sponge rollers 48 and brush rollers 49 may be co-rotating to achieve further changes and effects in the yarn.

In one embodiment, the dyes which shall be deposited by means of a feed-line system 50 are only deposited in this instance by feed stubs 51 from above on the rollers; this post-process does not use baths for treatments as in the previous discussion. However, this post-process may comprise a bath or trough for treatment as illustrated in FIG. 3.

At the exit (see arrow 18 of FIG. 1), the warps 9 and 10 are so hot that the entire set of warps can be printed, coated or worked-on with arbitrary patterns. For that purpose and as shown by FIG. 1, dye can be deposited on warps 9 and 10 by a further synchronous dye or deposition device 52 (FIG. 1), and at the same time the dye may be dried by being in contact with the hot warps. Thus, a novel interaction is created between the printing and coating material on one hand and on the other the warps by the printing or coating of these hot warps.

While the invention has been particularly shown and described with reference to a preferred embodiment, it will be understood by those having ordinary skill in the art that various changes in form and detail may be made therein without departing from the spirit and scope of the invention.

I claim:

1. A method for treating, and in particular, for dyeing fabric warp threads, comprising the step of:

passing a warp thread in a single operational step and in an in-line procedure through a bath means, said bath means comprising a sizing means for rigidifying said warp thread and making said warp thread wear-resistant, and a dye means in the form of a viscous material or in a pasty state for dyeing said warp thread.

2. The method according to claim 1 further comprising the step of weaving said warp thread to produce a textile.

3. The method according to claim 1 wherein said bath means comprises a mixture of said sizing means and said dye means contained in a single trough.

4. The method according to claim 1 wherein said bath means comprises a first trough for the sizing means and a second trough for the dye means, said first and second troughs being mounted directly one behind the other, the sizing means and the dye means being deposited in-line in a single operational stage.

5. The method according to claim 1, further comprising a step of drying said warp thread, wherein said bath means is mounted directly in front of a drying chamber, the warp thread being passed through said sizing means and dye means being subjected to drying in the drying chamber.

6. The method according to claim 5, further comprising a post-processing step after the step of drying, said post-processing step comprises printing and/or coating of said warp thread.

7. The method according to claim 6, wherein said post-processing step comprises a wet-in-wet procedure for further altering the appearance of said warp threads.

8. The method according to claim 5, further comprising a printing step, said printing step occurring after said drying step and comprising an in-line printing means provided directly beyond said drying chamber for coating said warp thread with dye, lacquer or dispersions.

9. The method according to claim 8, wherein said in-line printing means comprise a dye receptacle supplying dye means through at least one feed stub to the surfaces of at least one dying roller.

10. The method according to claim 8, wherein said printing step further comprises the step of compressing said warp thread between a printing roller and a rest surface.

11. The method according to claim 10, wherein said rest surface is a surface of a lower roller.

12. The method according to claim 11, wherein said surface of said lower roller is topologically shaped to entail different patterns on said warp thread.

13. The method according to claim 5, further comprising a conditioning step, said conditioning step following said drying step and conditions said warp thread by means of simultaneously running smoothing, sponge and brush means, said warp thread still hot from said drying step.

14. The method according to claim 5, further comprising a conditioning step, said conditioning step both preceding and following said drying step and serving to condition said warp thread by means of simultaneously running smoothing, sponge and brush means.

15. The method according to claim 5, further comprising the step of measuring a degree of drying in said drying chamber, wherein a measurement of said degree of drying controls a post-processing stage.

16. The method according to claim 1, wherein said sizing means and said dye means are adapted to be stored in a reservoir, and maintained in a fluid state, said sizing means and dye means being transferrable to said bath means.

17. The method according to claim 16, wherein said reservoir comprises at least one agitator for maintaining said sizing means and said dye means in said fluid state.

18. The method according to claim 1, further comprising an agitating step for maintaining said dye means in a fluid state.

19. The method according to claim 18, wherein said dye means is contained in at least one dye receptacle, said at least one dye receptacle comprising at least one agitator.

20. The method according to claim 19, wherein said agitation step comprises a partial agitation step for maintaining a portion of said dye means in a fluid state, said agitator adapted to perform said partial agitator step.

21. The method according to claim 20, characterized in that said partial agitation step result in marble veins or tracks being formed in said dye means, said marble veins or tracks being transferred to said warp thread.

22. The method according to claim 19, wherein said dye means is fed from said at least one dye receptacle to said bath means, said at least one receptacle comprising a return line and a pump means for returning unconsumed dye means and sizing means to said at least one receptacle.

* * * * *